United States Patent [19]

Nakajima et al.

[11] Patent Number: 4,891,079

[45] Date of Patent: Jan. 2, 1990

[54] HIGH SATURATED MAGNETIC FLUX DENSITY ALLOY

[75] Inventors: Mikio Nakajima; Akihiro Makino, both of Nagaoka, Japan

[73] Assignee: Alps Electric Co., Ltd., Tokyo, Japan

[21] Appl. No.: 252,827

[22] Filed: Oct. 3, 1988

[30] Foreign Application Priority Data

Jan. 14, 1988 [JP] Japan ..... 63-6410
Jun. 3, 1988 [JP] Japan ..... 63-136791

[51] Int. Cl.[4] ..... H01F 1/04

[52] U.S. Cl. ..... 148/307; 148/311; 420/103; 420/104; 420/117

[58] Field of Search ..... 148/307, 311; 420/104, 420/117, 103

[56] References Cited

U.S. PATENT DOCUMENTS 3,600,162 8/1971 Kaplan et al. .
4,246,049 1/1981 Bronner et al. ..... 148/311
4,748,000 5/1988 Hayashi et al. ..... 420/82

*Primary Examiner*—John P. Sheehan
*Attorney, Agent, or Firm*—Guy W. Shoup; Paul J. Winters

[57] ABSTRACT

According to the invention, a highly corrosion-resistant alloy that has a high saturated magnetic flux density and can be suitably used as a material for manufacturing magnetic heads is provided.

An alloy according to the invention is based on alloy of Fe-Co-Si-Al type to which Cr and Ru if desired are added in order to improve its saturated magnetic flux density and other magnetic characteristics as well as corrosion resistance without degrading its hardness and coercive force.

An alloy according to the invention typically contains 1.0 to 3% by weight of Cr as an additive and, if desired, 0.5 to 5% by weight of Ru.

3 Claims, 2 Drawing Sheets

Fe 91.5-xSi xCo 8 Al 0.5

Fe 91.5-xSi xCo 8 Al 0.5

HIGH SATURATED MAGNETIC FLUX DENSITY ALLOY

DESCRIPTION OF THE INVENTION

1. Field of Industry

Figure 1:
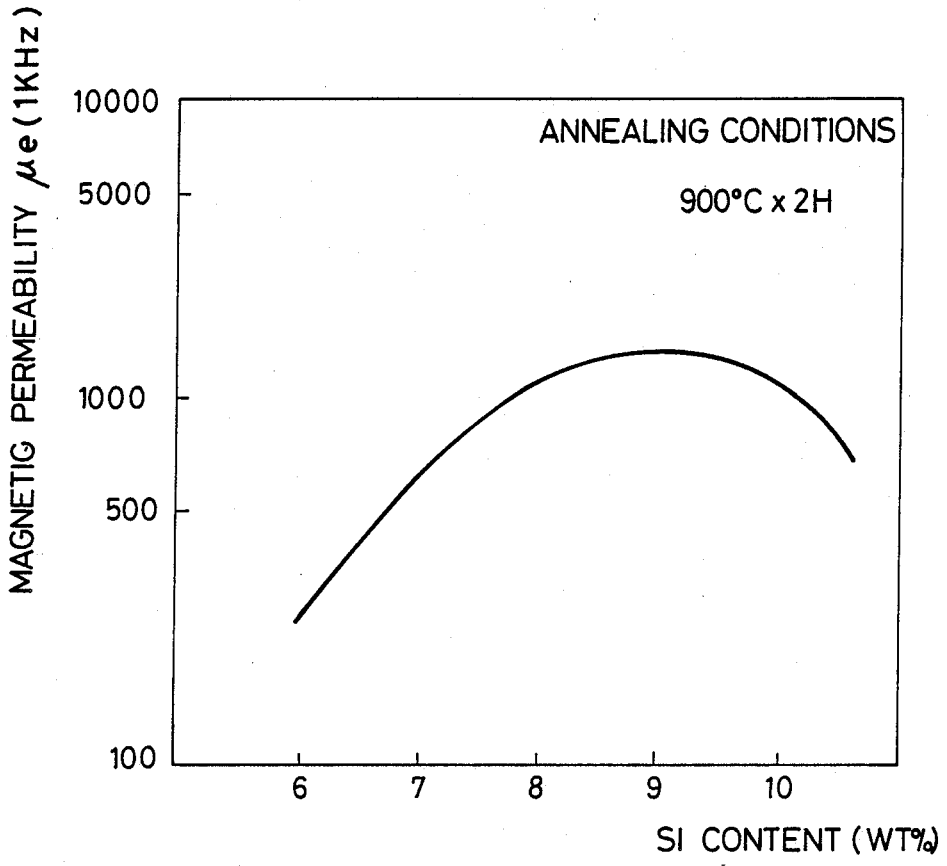

This invention relates to a highly corrosion-resistant alloy that has a high saturated magnetic flux density and can be suitably used as a material for manufacturing magnetic heads.

2. Prior Art

High saturated magnetic flux density materials to be used as materials for manufacturing magnetic heads are generally required to have the properties as listed in (1) to (5) below.

(1) a high magnetic flux density
(2) a high magnetic permeability
(3) a low coercive force
(4) a high hardness and a good abrasion resistance
(5) a high electric resistance Studies on a variety of alloy materials of this category have therefore been concentrated on the items as listed above.

One of the well known magnetic materials that have been favorably used for manufacturing magnetic heads is sendust of Fe-Si-Al type. Since sendust of this type has a high saturated magnetic flux density up to 11,000 gauss and a high hardness, it has been used as a material for magnetic heads to be used with audio- or videotapes comprising fine metal powder as a magnetic recording medium as well as those to be used with magnetic cards. In response to improvements that have been recently achieved for enhancement of the coercive force of the magnetic recording medium used in magnetic tapes, development of materials having a high saturated magnetic flux density to be used for manufacturing magnetic heads has been eagerly expected.

Of the high saturated magnetic flux density materials that have been proposed to meet the demand, alloys of Fe-Co type worth a closer examination. While an alloy of this type is very promising as they can have a saturated magnetic flux density (Bs) of up to 20,000 gauss, it is accompanied by a drawback of high magnetostriction and a significant drop of magnetic permeability that is observed after molding. Moreover, it is difficult for an alloy of this type to be cold-processed and therefore it is generally not feasible to form metal sheets or wores out of such an alloy material, proving itself to be an unviable material for magnetic head cores.

It is therefore an object of the present invention to provide a high saturated magnetic flux density alloy of Fe-Co-Si-Al type which is free from the above described drawbacks of alloys of Fe-Co-Si type and maintains a high saturated magnetic flux density even when it is processed to produce magnetic heads without showing degradation after molding.

It is another object of the present invention to provide a high saturated magnetic flux density alloy to which an additive is added in order to enhance its corrosion resistance.

In order to solve the above described problems, an alloy according to the present invention has a chemical composition of 3–20% by weight of Co,
6–12% by weight of Si,
0.1–3% by weight of Al and
the remaining % by weight of Fe.

Further, an alloy according to the present invention has a chemical composition of 3–20% by weight of Co,
6–12% by weight of Si,
0.1–3% by weight of Al,
1.5–4% by weight of Cr and
the remaining % by weight of Fe.

Still further, an alloy according to the present invention has a chemical composition of 3–20% by weight of Co,
6–12% by weight of Si,
0.1–3% by weight of Al,
0.5–5% by weight of Ru and
the remaining % by weight of Fe.

The Si content of an alloy according to the present invention is found between 6 and 12 % by weight because no magnetostriction zero condition is obtained when the Si content is lower than 6% by weight and a remarkable reduction of saturated magnetic flux density is observed to destroy the value of the alloy as a high saturated magnetic flux density material when the Si content is higher than 12% by weight. Similarly, the Co content is defined as being between 3 and 20% by weight because the alloy becomes very fragile when the Co content falls under 3% by weight and it shows a distorted magnetostriction when the Co content exceeds 20% by weight to such an extent that the saturated magnetic flux density becomes too low to ensure a magnetostriction zero condition unless the Si content is considerably increased. Further, the Al content of an alloy according to the present invention is defined as being between 0.1 and 3% by weight because addition of Al to this extent to an alloy of Fe-Co-Si type, which has a monoclinic system in coarse structural terms and is therefore very fragile, can significantly improve the fragility by transforming its crystal structure largely into an isometric system. In other words, an Al content between 0.1 and 3% by weight is an inevitable choice because, when the Al content falls short of 0.1% by weight, no transition from a monoclinic system to an isometric system takes place and, when the Al content exceeds 3% by weight, a reduction of the saturated magnetic flux density occurs.

If Cr alone is added to an alloy of Fe-Co-Si type, no improvement of corrosion resistance is observed when the Cr content is lower than 1.5% by weight, while the saturated magnetic flux density falls below 13,000 G when the Cr content exceeds 4% by weight. On the other hand, if both Cr and Ru are added to an alloy of the type as referred to above, a Cr content lower than 1% by weight does not show any significant effects and a Cr content higher than 4% by weight causes a remarkable reduction of the saturated magnetic flux density of the alloy, whereas a Ru content under 0.5% causes no significant effects and a Ru content above 5% by weight is accompanied by degradation of the magnetic characteristics of the alloy. It should be noted that addition of Cr to an alloy has an effect of improving the corrosion resistance of the alloy and addition of Ru can, in synergism with Cr, boost the improvement of corrosion resistance on one hand and curb reduction of saturated magnetic flux density that can be caused by addition of Co on the other.

It should also be noted that an alloy according to the present invention can be produced by means of a smelting process using an electric arc furnace, a vacuum smelting process, a powder metallurgic process or any other proven processes.

EXAMPLE 1

A number of ring shaped samples each having identical dimensions of 10 mm outer diameter, 6 mm inner diameter and 1 mm height but having a composition which is different from each other within the above defined percentage ranges were prepared from alloys of Fe-Co-Si-Al type according to the present invention and having corresponding compositions which had been produced in an electric arc furnace. For comparison purposes, a number of controls each having an identical size but having its Si, Co or Al content found outside of the defined ranges were also prepared.

Each of the prepared samples and the controls was then subjected to a series of tests to determine the initial magnetic permeability, the permeability after mold degradation, the initial coercive force, the coercive force after mold degradation, the saturated magnetic flux density, the Vickers hardness and the fracture strength. Tables 1 and 2 shows the result of the test.

TABLE 1

| Sample No. | | Alloy composition (Wt %) Si | Co | Al | Auxiliary ingredients | Fe | Alternative current magnetic permeability μe (f = 1 kHz) Initial | Degradation |
|---|---|---|---|---|---|---|---|---|
| Controls | 1 | — | 50 | — | — | Remaining portion | 240 | 180 |
| | 2 | — | 49 | — | V2 | Remaining portion | 380 | 270 |
| | 3 | 7 | 5 | — | — | Remaining portion | 1100 | 1070 |
| | 4 | 8 | 8 | — | — | Remaining portion | 1220 | 1160 |
| Samples | 5 | 7 | 5 | 1 | — | Remaining portion | 1050 | 1030 |
| of the | 6 | 8 | 8 | 1 | — | Remaining portion | 950 | 810 |
| invention | 7 | 7 | 5 | 0.5 | — | Remaining portion | 1090 | 1090 |
| | 8 | 7.5 | 8 | 0.5 | — | Remaining portion | 1150 | 1140 |
| | 9 | 8 | 8 | 0.5 | — | Remaining portion | 1380 | 1480 |
| | 10 | 8.5 | 8 | 0.5 | — | Remaining portion | 1320 | 1200 |
| | 11 | 9 | 8 | 0.5 | — | Remaining portion | 1240 | 1240 |
| | 12 | 10 | 8 | 0.5 | — | Remaining portion | 1150 | 1320 |
| | 13 | 8 | 8 | 1.5 | — | Remaining portion | 1050 | 1050 |
| | 14 | 9 | 8 | 1.5 | — | Remaining portion | 1120 | 1120 |
| | 15 | 9 | 20 | 0.5 | — | Remaining portion | 1080 | 1080 |
| | 16 | 10 | 20 | 0.5 | — | Remaining portion | 1200 | 1190 |

TABLE 2

| | No. Sample No. | Direct current magnetic properties: Coercive force Hc(Oe) Initial | Degradation | Saturated magnetic flux density Bs (G) | Vickers hardness | Fracture strength (kg/mm²) |
|---|---|---|---|---|---|---|
| Controls | 1 | 1.3 | 1.5 | 22500 | 205 | — |
| | 2 | 2.1 | 1.3 | 22000 | 220 | — |
| | 3 | 0.14 | 0.14 | 18000 | 399 | 9.4 |
| | 4 | 0.13 | 0.13 | 17000 | 391 | 7.4 |
| Samples | 5 | 0.20 | 0.20 | 16700 | 458 | 17 |
| of the | 6 | 0.14 | 0.08 | 15700 | 455 | 24.8 |
| | 7 | 0.12 | 0.12 | 17400 | 5.3 | 42.4 |

TABLE 2-continued

| | No. Sample No. | Direct current magnetic properties: Coercive force Hc(Oe) Initial | Degradation | Saturated magnetic flux density Bs (G) | Vickers hardness | Fracture strength (kg/mm²) |
|---|---|---|---|---|---|---|
| invention | 8 | 0.16 | 0.17 | 16700 | 434 | 43.1 |
| | 9 | 0.13 | 0.13 | 16400 | 498 | 19.9 |
| | 10 | 0.12 | 0.14 | 16100 | 483 | 32.2 |
| | 11 | 0.22 | 0.18 | 15800 | 465 | 23.4 |
| | 12 | 0.35 | 0.21 | 15000 | 513 | 29.7 |
| | 13 | 0.13 | 0.13 | 14700 | 457 | 30.8 |
| | 14 | 0.11 | 0.12 | 14000 | 468 | 28.7 |
| | 15 | 0.12 | 0.13 | 15000 | 473 | 18.7 |
| | 16 | 0.21 | 0.2 | 14300 | 524 | 16.5 |

As seen from Tables 1 and 2, each of samples Nos. 5 through 16 which were made of alloys according to the present invention showed a remarkably high fracture strength as compared with controls Nos. 3 and 4, each of which was made from an alloy of Fe-Co-Si type containing no Al additive and a relatively low coercive force. Similarly each of samples Nos. 5 through 15 showed a remarkably high permeability and a low coercive force as well as a high Vickers hardness as compared with controls Nos. 1 and 2 which were made of alloys of Fe-Co type. Moreover, each of samples Nos. 5 through 16 showed a saturated magnetic flux density higher than 14,000 G, a value which is higher than that of sendust.

It should be noted that, as Tables 1 and 2 show, Al additive containing samples Nos. 5 and 7 showed a remarkably low level of permeability degradation and a high level of fracture strength as compared with control No. 3 containing no Al additive. Similarly, Al additive containing samples Nos. 6, 9 and 13 showed a high level of fracture strength and other excellent properties as compared with control No. 4 containing no Al additive. FIG. 1 illustrates the relationship between Si content and magnetic permeability $\mu e$ (f=1 kHz) after molding of an alloy having a chemical composition of $Fe_{91.5-x}$ $Si_x$ $Co_8$ $Al_{0.5}$.

As shown in FIG. 1, it is apparent that an alloy of this type containing Si at a level between 6 and 12% by weight has a good permeability.

As proved by the above tests, an alloy of Fe-Co-Si type containing each component at a specific level and to which Al is added by a specific percentage has a highly improved fracture strength without losing its original magnetic characteristics.

Hence, an alloy according to the present invention is good for use for magnetic heads, showing an excellent saturated magnetic flux density higher than 14,000 G, a high magnetic permeability and a low coercive force as well as good magnetic characteristics after molding and a high Vickers hardness. A magnetic head made of such an alloy has an excellent anti-abrasion property and a satisfactory level of workability.

Now an example of the embodiment of the present invention having an improved corrosion-resistance higher than that of the above example of Fe-Co-Si-Al type will be described.

EXAMPLE 2

300 g of an alloy of Fe-Co-Si-Al type to which a certain amount of additive was added was produced by means of an arc smelting furnace and than a number of samples having the dimensions of 10 mm outer diameter, 6 mm inner diameter and 1 mm thickness were prepared therefrom by means of an electric discharge process. A number of controls having composition other than defined by the present invention were also prepared.

The samples and some of the controls were then subjected to an annealing treatment of heating at 900° C. for two hours in a hydrogeneous atmosphere followed by cooling in a furnace. These specimens were tested for magnetic characteristics and Vickers hardness. For magnetic characteristics, the specimens were tested for magnetic permeability and coercive force before and after the heat treatment. The saturated magnetic flux density of each of the specimens were also determined. All the samples and the controls were also tested for corrosiveness by leaving them in air at 60° C. and 95% relative humidity for 96 hours and by thereafter observing their rusting status. The specimens which were observed to be rusting evenly all over the surface were marked with, x, those which were rusting scatteredly were marked with Δ and those free from rusting were marked with = . Tables 3 and 4 show the compositions and the test results of the samples and the controls.

It is apparent from Tables 3 and 4 that Samples Nos. 5 through 15 of alloys according to the present invention have an improved corrosion resistance as compared with that of controls Nos. 3 and 4 which do not contain Cr and or Ru as additives.

TABLE 3

| | Sample No. | Alloy composition (Wt %) Si | Co | Al | Cr | Ru | Fe | Corrosion test rating |
|---|---|---|---|---|---|---|---|---|
| Controls | 1 | 9.5 | — | 5.5 | — | — | Remaining portion | X |
| | 2 | 6 | — | 4 | — | Ni 3.2 | Remaining portion | Δ |
| | 3 | 7 | 5 | 1 | — | — | Remaining portion | Δ |
| | 4 | 8 | 8 | 1 | — | — | Remaining portion | |
| Samples of the invention | 5 | 8.5 | 8 | 0.2 | 1 | 5 | Remaining portion | |
| | 6 | 9 | 8 | 0.2 | 1.5 | 1 | Remaining portion | |
| | 7 | 9 | 8 | 0.2 | 1.5 | 5 | Remaining portion | |
| | 8 | 9.5 | 8 | 0.2 | 2 | — | Remaining portion | |
| | 9 | 10.5 | 8 | 0.2 | 3 | — | Remaining portion | |
| | 10 | 8 | 3 | 0.5 | 1 | 5 | Remaining portion | |
| | 11 | 9.5 | 20 | 0.5 | 1 | 5 | Remaining portion | |
| | 12 | 9 | 3 | 0.5 | 2 | — | Remaining portion | |
| | 13 | 10.5 | 20 | 0.5 | 2 | — | Remaining portion | |
| | 14 | 8.5 | 8 | 1.5 | 1 | 5 | Remaining portion | |
| | 15 | 9.5 | 8 | 1.5 | 2 | — | Remaining portion | |
| Controls | 16 | 8 | 8 | 0.2 | 1 | — | Remaining portion | Δ |
| | 17 | 8 | 8 | 0.2 | 0.5 | 10 | Remaining portion | Δ |
| Samples of the invention | 18 | 9 | 8 | 0.2 | 1.5 | — | Remaining portion | |
| | 19 | 9 | 8 | 0.2 | 1.5 | 0.5 | Remaining portion | |
| | 20 | 10.5 | 8 | 0.2 | 3 | 0.5 | Remaining portion | |

TABLE 4

| | Sample No. | Magnetic properties: Permeability μe Initial | Permeability μe Degradation | Coercive force Hc (Oe) Initial | Coercive force Hc (Oe) Degradation | Saturated magnetic flux density Bs (G) | Vickers hardness Hv |
|---|---|---|---|---|---|---|---|
| Controls | 1 | — | — | — | — | — | — |
| | 2 | — | — | — | — | — | — |
| | 3 | — | — | — | — | — | — |
| | 4 | — | — | — | — | — | — |
| Samples of the 6 invention | 5 | 1372 | 1528 | 0.106 | 0.103 | 15000 | 498 |
| | 1340 | 1248 | 0.162 | 0.134 | 14800 | 445 | |
| | 7 | 1215 | 1210 | 0.151 | 0.159 | 14400 | 440 |
| | 8 | 1108 | 1148 | 0.213 | 0.151 | 14100 | 448 |
| | 9 | 980 | 1020 | 0.118 | 0.131 | 13100 | 468 |
| | 10 | 880 | 992 | 0.180 | 0.150 | 15300 | 487 |
| | 11 | 1152 | 1096 | 0.150 | 0.160 | 14400 | 441 |

TABLE 4-continued

| | Sample No. | Magnetic properties: Permeability μe Initial | Permeability μe Degradation | Coercive force Hc (Oe) Initial | Coercive force Hc (Oe) Degradation | Saturated magnetic flux density Bs (G) | Vickers hardness Hv |
|---|---|---|---|---|---|---|---|
| | 12 | 956 | 952 | 0.118 | 0.118 | 14600 | 453 |
| | 13 | 1280 | 1132 | 0.143 | 0.116 | 13700 | 448 |
| | 14 | 1170 | 1140 | 0.135 | 0.138 | 14000 | 466 |
| | 15 | 1130 | 1100 | 0.126 | 0.140 | 13300 | 473 |
| Controls | 16 | 1372 | 1328 | 0.103 | 0.106 | 16000 | 460 |
| | 17 | 648 | 208 | 0.300 | 0.850 | 15000 | 408 |
| Samples | 18 | 1152 | 1044 | 0.107 | 0.115 | 15000 | 455 |
| of the | 19 | 1192 | 1060 | 0.114 | 0.119 | 14800 | 475 |
| invention | 20 | 1092 | 1072 | 0.101 | 0.113 | 13000 | 455 |

All alloy samples Nos. 5 through 15 and Nos. 18 through 20 according to the invention showed a saturated magnetic flux density higher than 13,000 G which is higher than the saturated magnetic flux density of proven sendust (11,000 G). The samples also showed excellent magnetic characteristics, each having a satisfactorily high magnetic permeability and coercive force.

Of samples Nos. 8, 9, 12, 13, 15, 16 and 18, which were made of alloys of Fe-Co-Si-Al type containing Cr as an additive, sample No. 9 containing 3% by weight of Cr showed a somewhat reduced magnetic flux density of 13,100 G. On the other hand, it becomes apparent by comparing control No. 16 and sample No. 18 that, when the Cr content was reduced from 1.5% by weight of sample No. 18 down to 1.0% by weight of control No. 16, a reduction of corrosion-resistance occurred. These observations led to the conclusion that the upper and lower limits of added Cr content should be defined at 4% by weight and 1.5% by weight respectively.

Figure 2:
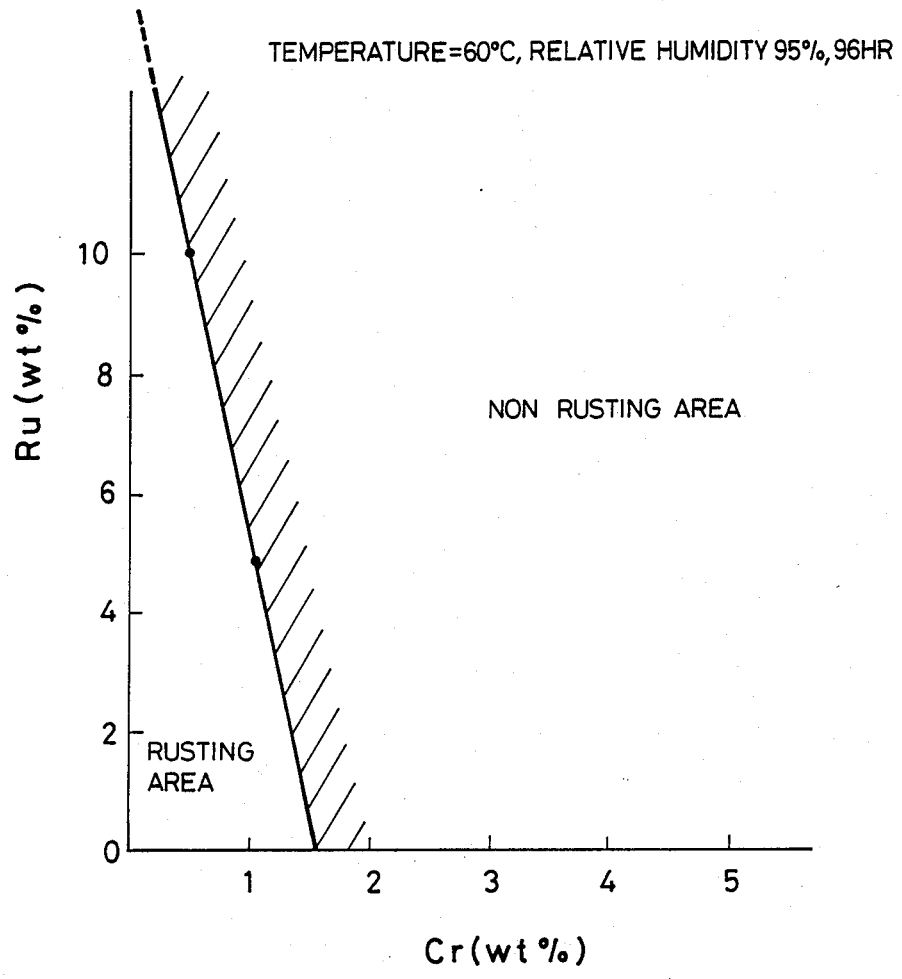

Specimens Nos. 5, 6, 7, 10, 11, 14, 17, 19 and 20 were made of alloys of Fe-Co-Si-Al type to which both Cr and Ru were added. By comparing specimens Nos. 5, 7 and 17, it is apparent that, while a Ru content of 5% by weight improves the properties of an alloy of this type, a Ru content of 10% by weight causes a remarkable reduction of magnetic permeability. Besides, a Cr content of 3% by weight can reduce the saturated magnetic flux density down to 13,000 G as in the case of sample No. 20. FIG. 2 illustrates the relationship between the Cr content and the Ru content in terms of rusting.

The above observations led to the defined Cr content range of 1 to 4% by weight and the Ru content range of 0.5 to 5% by weight of the present invention.

As proved by the above described experiments, an alloy according to the present invention is good for use for magnetic head cores as it has an excellent saturated magnetic flux density of higher than 13,000 G., a high magnetic permeability and a low coercive force along with remarkable magnetic characteristics after molding, a high Vickers hardness, and hence a high abrasion-resistance and an excellent corrosion-resistance, therefore fulfilling so many of the requirements for producing high quality magnetic heads.

Therefore, it is concluded that an alloy according to the present invention provides an excellent material for magnetic heads to be used with magnetic cards, audio and video recording equipments and other magnetic recording devices which are becoming increasingly sophisticated these days.

EFFECTS OF THE INVENTION

As described above, an alloy according to the present invention containing as its ingredients 3 to 20% by weight of Co, 6 to 12% by weight of Si, 0.1 to 3% by weight of Al and the remaining portion of Fe shows little degradation of magnetic permeability after molding and a high saturated magnetic flux density of between 14,000 and 18,000 G as well as a high fracture strength.

Therefore, an alloy according to the present invention having excellent magnetic characteristics including a high magnetic permeability and a low coercive force after molding as well as an excellent saturated magnetic flux density which is higher than that of sendust and a high abrasion resistance with a remarkably high Vickers hardness provides a magnetic material for magnetic heads to be suitably used with various magnetic devices which are becoming increasingly sophisticated these days.

It should be noted that an alloy according to the present invention which contains Fe as its principal ingredient and Co, Si, Al and Cr or Co, Si, Al, Cr and Ru at a specific level provides a magnetic material having excellent magnetic characteristics that will hardly be degradated after molding and includes a high saturated magnetic flux density of 13,000 G or above, an excellent hardness and an enhanced corrosion-resistance.

What is claimed is;

1. High saturated magnetic flux density alloy having a chemical composition of
   3–20% by weight of Co,
   6–12% by weight of Si,
   0.1–3% by weight of Al and
   the remaining % by weight of Fe.

2. High saturated magnetic flux density alloy having a chemical composition of
   3–20% by weight of Co,
   6–12% by weight of Si,
   0.1–3% by weight of Al,
   1.5–4% by weight of Cr and
   the remaining % by weight of Fe.

3. High saturated magnetic flux density alloy having a chemical composition of
   3–20% by weight of Co,
   6–12% by weight of Si,
   0.1–3% by weight of Al
   1.0–3% by weight of Cr
   0.5–5% by weight of Ru and
   the remaining % by weight of Fe.

* * * * *